US008967190B2

(12) United States Patent
Keizers

(10) Patent No.: US 8,967,190 B2
(45) Date of Patent: Mar. 3, 2015

(54) DRAIN WITH ADJUSTING FRAME

(75) Inventor: Jurgen Hendrik Peter Jozef Keizers, Losser (NL)

(73) Assignee: Easy Sanitary Solutions B.V., Losser (NL)

( * ) Notice: Subject to any disclaimer, the term of this patent is extended or adjusted under 35 U.S.C. 154(b) by 661 days.

(21) Appl. No.: 12/812,704

(22) PCT Filed: Jan. 12, 2009

(86) PCT No.: PCT/NL2009/050004
§ 371 (c)(1),
(2), (4) Date: Sep. 29, 2010

(87) PCT Pub. No.: WO2009/091245
PCT Pub. Date: Jul. 23, 2009

(65) Prior Publication Data

US 2011/0023978 A1 Feb. 3, 2011

(30) Foreign Application Priority Data

Jan. 14, 2008 (NL) ..... 1034911

(51) Int. Cl.
*F16L 5/00* (2006.01)
*E03F 5/04* (2006.01)

(52) U.S. Cl.
CPC ..... *E03F 5/0408* (2013.01); *E03F 5/0407* (2013.01); *E03F 2005/0413* (2013.01)
USPC ..... 137/362

(58) Field of Classification Search
CPC ..... E03F 5/0407; E03C 1/22; E03C 1/26
USPC ..... 137/362; 4/286, 288, 291, 292, 679; 52/302.1, 302.3; 210/163, 164
See application file for complete search history.

(56) References Cited

U.S. PATENT DOCUMENTS

| | | | | | |
|---|---|---|---|---|---|
| 2,749,999 | A * | 6/1956 | Schmid | 210/165 |
| 3,246,582 | A * | 4/1966 | Wade et al. | 210/165 |
| 3,418,669 | A * | 12/1968 | Maxwell | 4/286 |
| 3,774,765 | A * | 11/1973 | Kane et al. | 210/164 |
| 4,553,874 | A * | 11/1985 | Thomann et al. | 404/4 |
| 4,871,451 | A * | 10/1989 | Piskula | 210/164 |
| 4,883,590 | A * | 11/1989 | Papp | 210/164 |
| 5,010,700 | A * | 4/1991 | Blair | 52/199 |
| 5,154,024 | A * | 10/1992 | Noel | 52/12 |
| 6,170,095 | B1 * | 1/2001 | Zars | 4/507 |
| 6,179,518 | B1 * | 1/2001 | Suatac | 404/26 |
| 6,483,701 | B1 * | 11/2002 | Ta et al. | 361/695 |
| 6,997,639 | B2 * | 2/2006 | Nadasde | 404/26 |
| 7,246,472 | B2 * | 7/2007 | Nielsen | 52/302.3 |

FOREIGN PATENT DOCUMENTS

| | | | |
|---|---|---|---|
| DE | 202006014745 | U1 | 11/2006 |
| EP | 1647642 | A2 | 4/2006 |
| JP | 2002294853 | | 10/2002 |
| WO | 0173231 | A1 | 10/2001 |

* cited by examiner

*Primary Examiner* — Kevin Murphy
(74) *Attorney, Agent, or Firm* — The Webb Law Firm

(57) ABSTRACT

The invention relates to a drain, comprising: a container with a bottom surface and an upright edge along the periphery of the bottom surface; a discharge opening arranged in the bottom surface of the container; an adjusting frame placed on the container and having adjusting means for adjusting the height of the top side of the adjusting frame; wherein the adjusting frame fits within the upright edge and the adjusting frame is manufactured from strip material.

9 Claims, 3 Drawing Sheets

DRAIN WITH ADJUSTING FRAME

BACKGROUND OF THE INVENTION

The invention relates to a drain, comprising:

a container with a bottom surface and an upright edge along the periphery of the bottom surface;

a discharge opening arranged in the bottom surface of the container;

an adjusting frame placed on the container and having adjusting means for adjusting the height of the top side of the adjusting frame.

Such drains are for instance used in tiled floors. The container is then arranged in the concrete sub-floor, after which the adjusting frame is set such that the top side of the adjusting frame lies flush with the top surface of the tiles. This adjusting frame provides for a neat finish of the side of the tiles.

Drains known in the prior art have an adjusting frame which is manufactured from sheet steel. This results in a relatively wide edge. In addition, such an adjusting frame manufactured from bent sheet steel is difficult to make to the desired tolerances. Furthermore, with adjusting frames manufactured from bent sheet steel it is practically impossible to make an adjusting frame with a form other than a rectangular form. A drain in the shape of a circle or heart is for instance not possible with such drains. In addition, the prior art adjusting frames are larger than the container, whereby the frame must be present during assembly and tiling.

It is now an object of the invention to reduce or even obviate the above stated drawbacks.

SUMMARY OF THE INVENTION

This object is achieved according to the invention with a drain characterized in that the adjusting frame fits within the upright edge and that the adjusting frame is manufactured from strip material. Any desired form can be made with a strip material. The use of strip material moreover has the advantage that accurate tolerances can be obtained. Finally, the upper surface of a strip material is relatively small. Compared to a bent steel sheet, the upper surface of the adjusting frame manufactured from a strip material is smaller. Little water can hereby flow over the small upper surface of the adjusting frame. In addition, the container can be incorporated per se into a floor in that the inner dimensions of the upright edge are also the outer dimensions of the adjusting frame.

In an embodiment of the drain according to the invention the bottom surface of the container is rectangular and the adjusting frame lies against the upright edge of the container.

In a preferred embodiment of the drain according to the invention a mastic sealant is arranged between the adjusting frame and the upright edge of the container. This sealant ensures that no water can flow under the tiles from the container.

In another embodiment of the drain according to the invention the adjusting means support on the bottom surface of the container. A simple construction is hereby obtained. It is however also possible to have the adjusting means support on protrusions arranged in the upright edge.

In another preferred embodiment of the drain according to the invention the container is provided with a flange along the upper edge of the upright edge. Using the flange the container is arranged in a concrete sub-floor and the tiles are laid at least partially over the flange. A mastic sealant can here be arranged as required between the upright edge of the container and the adjusting frame. If the mastic sealant is omitted the advantage can be gained that, in the case of leakage through the tile floor, the water can still flow to the drain over the top side of the concrete substrate.

In a highly preferred embodiment of the drain according to the invention the flange is at least partly flexible. Particularly when such a gutter is arranged between two walls a fixed flange can form a limitation in that this flange requires a certain distance between the container and the wall. By now giving the flange an at least partly flexible form the container can still be laid closely against the wall, wherein the flexible flange is folded upward and partially covered by for instance wall tiles. The invention further comprises a container for a drain according to the invention, which container is provided with a bottom surface, a discharge opening arranged in the bottom surface, an upright edge arranged along the periphery of the bottom surface, and a flange is provided along the upper edge of the upright edge. The flange is preferably at least partly flexible.

The container or drain according to the invention is preferably of sheet steel. This provides a simple method for manufacturing a container. The sheet steel container forms a cost-effective solution, particularly in combination with the adjusting frame.

BRIEF DESCRIPTION OF THE DRAWINGS

These and other features of the invention are further elucidated with reference to the accompanying drawings.

DETAILED DESCRIPTION OF THE PREFERRED EMBODIMENTS

Figure 1:
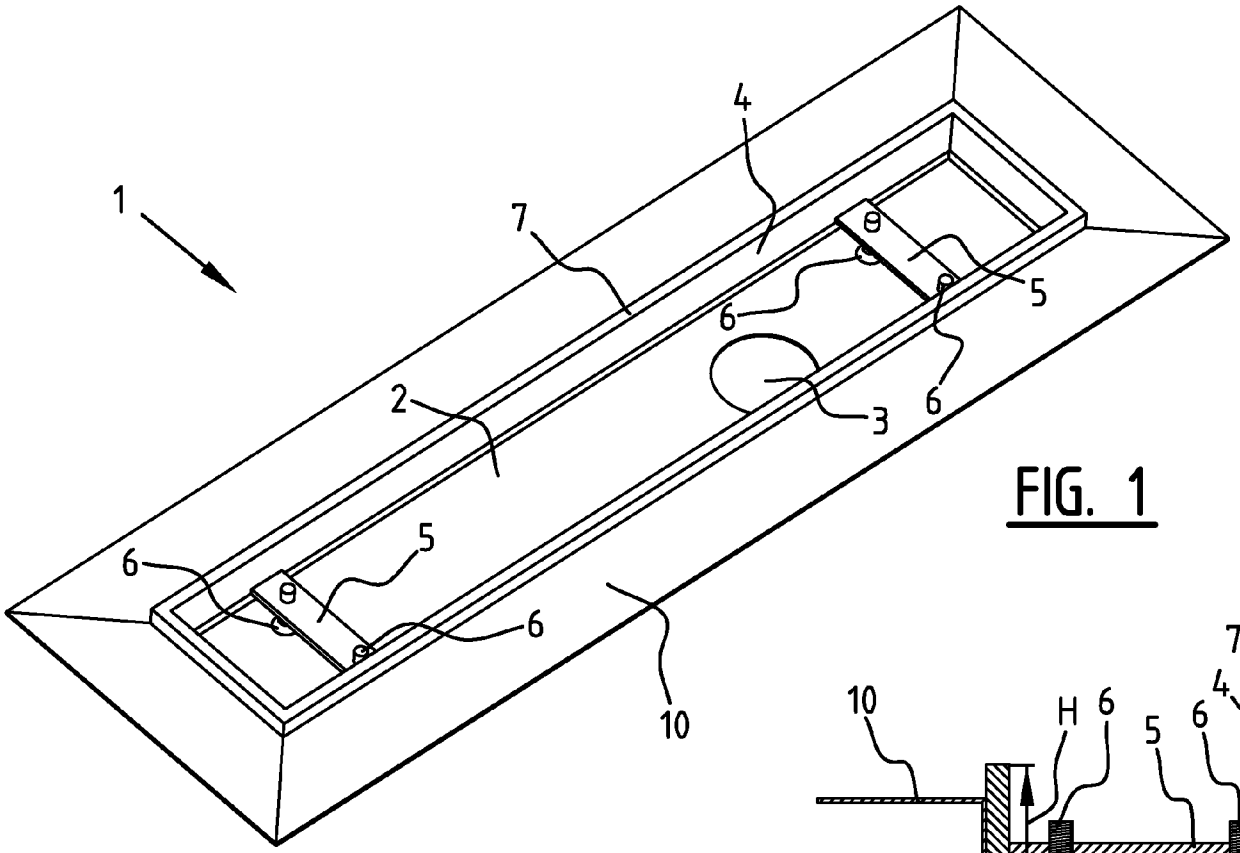
FIG. 1 shows a perspective view of an embodiment of a drain according to the invention.

FIG. 1 shows a drain 1 according to the invention. This drain 1 has a sheet steel container 2 with a discharge opening 3. This discharge opening 3 is placed asymmetrically in container 2. Particularly in the case of a joist floor the container 2 can then be placed such that discharge opening 3 fits between two joists and structural modifications to the floor can be avoided. An adjusting frame 4 is arranged in sheet steel container 2. This adjusting frame 4 is manufactured from a strip of metal which is bent into a rectangular shape. Arranged on the underside of adjusting frame 4 are two transverse connections 5 in which adjusting bolts 6 are placed. By rotating the adjusting bolts 6 the height of upper edge 7 of adjusting frame 4 can be adjusted such that in the finished situation of drain 1 upper edge 7 lies flush with for instance the top surface of a tiled floor.

Figure 2:
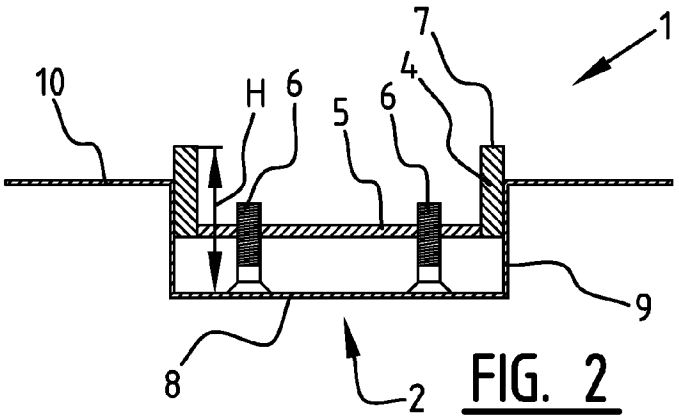
FIG. 2 shows a cross-sectional view of the drain according to FIG. 1.

FIG. 2 shows a cross-section of drain 1 according to FIG. 1. Container 2 has a bottom surface 8 with an upright edge 9 along the periphery. Provided on the upper side of upright edge 9 is a flange 10 which is substantially parallel to bottom surface 8. In one embodiment, the flange 10 is arranged along a top surface of the upright edge 9.

FIG. 2 further shows how adjusting bolts 6 rest on bottom surface 8 and that the height H of the upper surface 7 of adjusting frame 4 can be adjusted relative to bottom surface 8 by rotating the adjusting bolts 6 screwed into connecting piece 5. As seen in *Fig*. 2, the adjusting bolts 6 are not attached to the bottom surface 8 or the container 2.

Figures 3, 4:
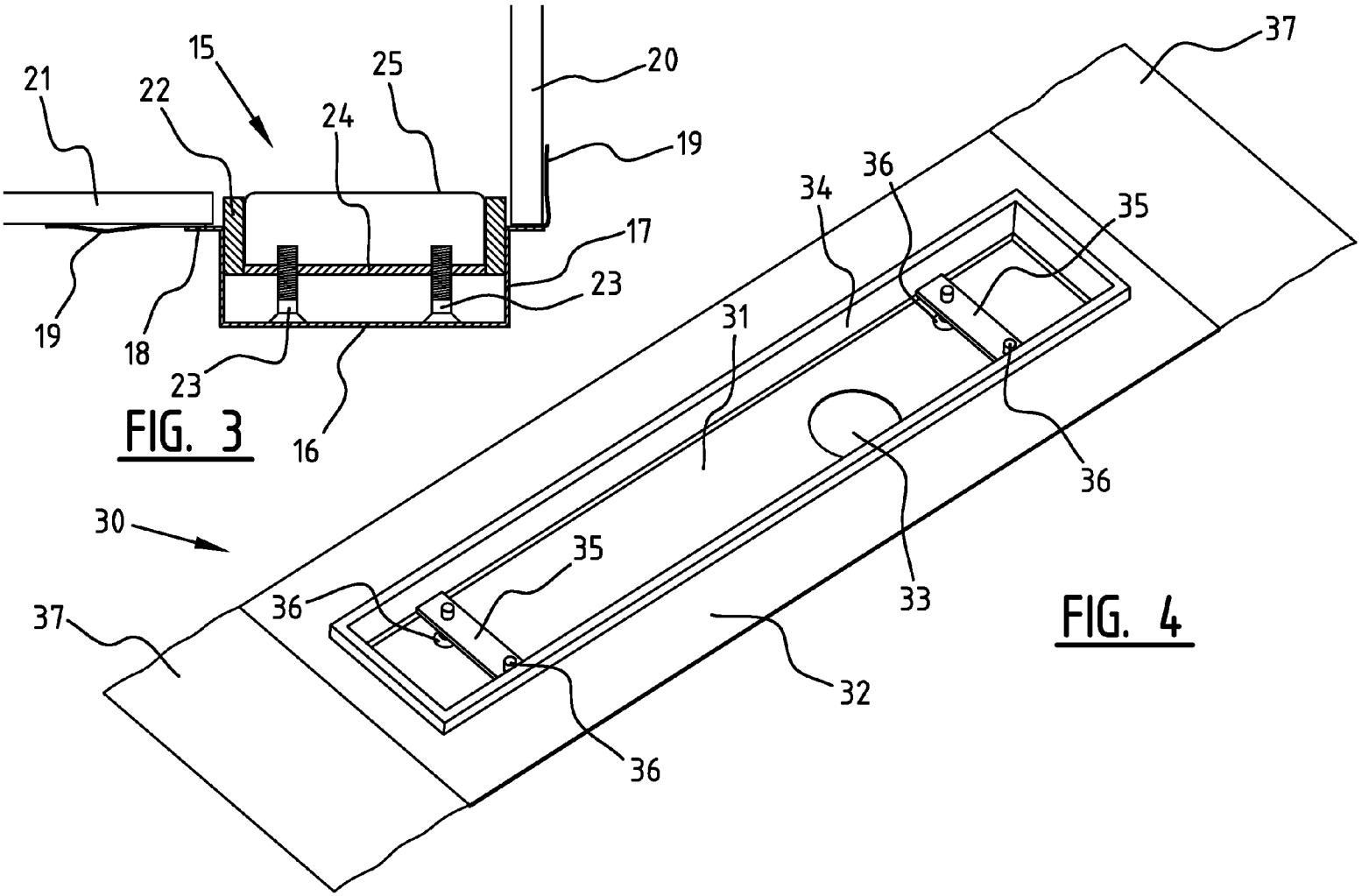
FIG. 3 shows a second embodiment of the drain according to the invention.
FIG. 4 shows a perspective view of a third embodiment.

FIG. 3 shows a second embodiment 15 of the invention. Drain 15 here also has a container with a bottom surface 16, an upright edge 17 and a flange 18 arranged thereon. Flange 18 is extended by means of a flexible flange part 19. Using this flexible flange part 19 it is possible to arrange container 16, 17, 18 closely against a wall by folding and arranging the flexible flange part behind wall tiles 20. As shown in FIG. 3, floor tiles 21 are arranged on flange 18, 19 on the other side of the container.

Further arranged once again in the container is an adjusting frame 22 of a strip material and adjusting bolts 23 with which the upper surface of adjusting frame 22 can be made flush with the top surface of floor tiles 21.

Further placed on strengthening strip 24 is a grating 25 which conceals the opening of drain 15 from view and provides an aesthetic appearance. Adjusting frame 22 and adjusting bolts 23 can moreover be used to make the top surface of grating 25 flush with the top surface of floor tiles 21.

FIG. 4 shows a third embodiment 30 according to the invention. This embodiment corresponds largely with the embodiment according to FIG. 1. A container 31 has an upright edge with a flange 32 fixed thereto. A discharge opening 33 is arranged asymmetrically in the bottom of container 31. Placed in container 31 is an adjusting frame 34 which consists of strip material and can be adjusted in the height by means of transverse connections 35 and adjusting bolts 36. The adjusting frame can optionally be positioned at a slight angle by unscrewing the adjusting bolts 36 to greater or lesser extent on one side than on the other side. On the end surfaces flange 32 is shortened and flexible flaps 37 are arranged. This drain 30 can hereby be arranged between two walls so that after tiling of the two walls there is substantially no longer any space between the tiles and adjusting frame 34.

Figure 5:
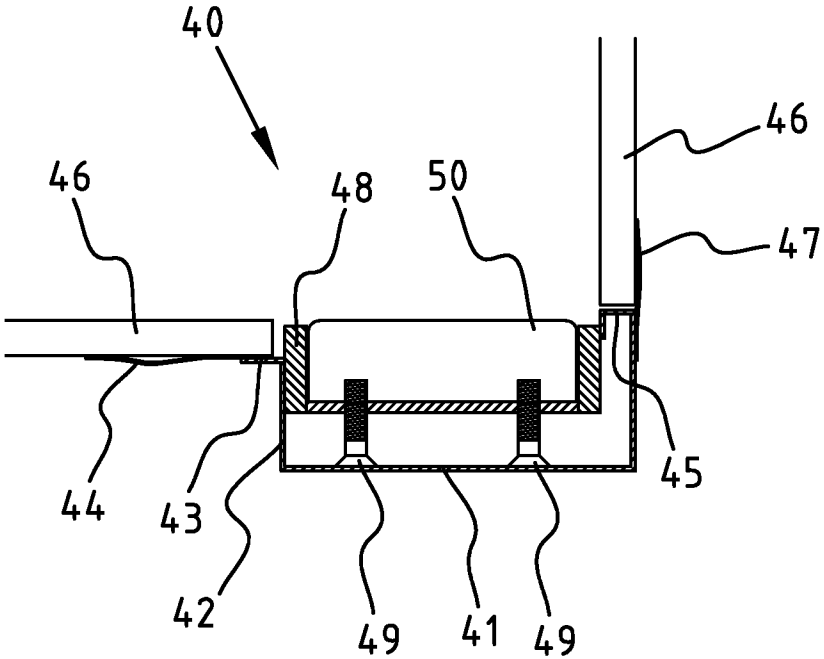
FIG. 5 shows a cross-sectional view of a fourth embodiment.

FIG. 5 shows a fourth embodiment 40 of the drain according to the invention. In this embodiment a container 41 is likewise provided with an upright edge 42 and a flange 43 on which a flexible flange part 44 is arranged. On one side the upright edge 42 is lengthened and edge 45 is bent inward. This creates a wide edge on which tiles 46 can be placed. A flexible seal 47 is arranged for sealing purposes.

An adjusting frame 48 is further placed in container 41, this frame being height-adjustable by means of adjusting bolts 49. Finally, a grating 50 is placed on adjusting frame 48.

The advantage of bent edge 45 is that drain 40 can be installed closely against a wall and that a neat finish is obtained due to bent edge 45.

Figure 6:
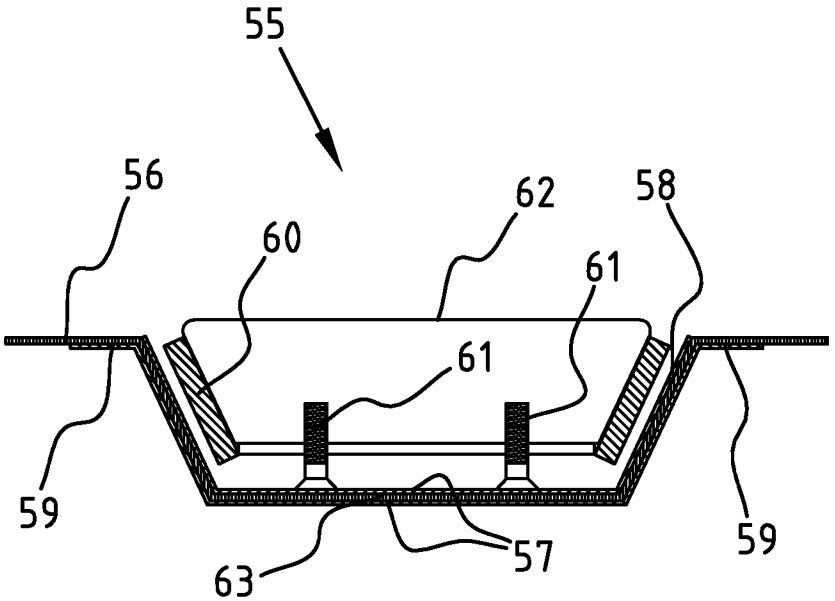
FIG. 6 shows a cross-sectional view of a fifth embodiment.

Finally, FIG. 6 shows a fifth embodiment 55. This variant is particularly suitable for arranging a drain 55 floors completely covered with a vinyl layer 56. This is usual for instance in the case of wooden floors. Drain 55 likewise has a container 57, the upright edge 58 of which runs obliquely outward. A flange 59 is further provided on upright edge 58. As is usual, container 57 is fixed to the ground by means of screws. The vinyl 56 is laid in drain container 57, after which an inner container part 63 is placed on drain container 57. This inner container part 63 is screwed into place, whereby it is tightened against drain container 57 and vinyl 56 is secured.

A matching adjusting frame 60 is further provided in drain 55, this frame once again being height-adjustable by means of adjusting bolts 61. The drain is further covered by a grating 62.

The invention claimed is:

1. A drain, comprising:

a container with a bottom surface, a top side, and an upright edge along the periphery of the bottom surface; wherein the container is provided with a flange along a top surface of the upright edge;

a discharge opening arranged in the bottom surface of the container; and an adjusting frame placed on the container and having an upper surface and adjusting means for adjusting the height of the upper surface of the adjusting frame, wherein the adjusting frame is freely slidable within the container;

wherein the adjusting frame fits within the upright edge and that the adjusting frame is manufactured from strip material; and wherein the adjusting means rest on the bottom surface of the container and are not attached to the bottom surface.

2. The drain as claimed in claim 1, wherein the bottom surface of the container is rectangular and the adjusting frame lies against the upright edge of the container.

3. The drain as claimed in claim 2, wherein a mastic sealant is arranged between the adjusting frame and the upright edge of the container.

4. The drain as claimed in claim 1, wherein the adjusting means is supported on the bottom surface of the container.

5. The drain as claimed in claim 1, wherein the flange is at least partly flexible.

6. The drain as claimed in claim 1, wherein the container is formed of sheet steel.

7. A container for a drain wherein the container is provided with a bottom surface, a discharge opening arranged in the bottom surface, an upright edge arranged along the periphery of the bottom surface, a flange arranged along a top surface of the upright edge, and wherein the container is adapted to receive an adjusting frame with an upper surface and an adjusting means for adjusting the height of the upper surface of the adjusting frame, wherein the adjusting frame is freely slidable within the container and wherein the adjusting means rest on the bottom surface of the container and are not attached to the bottom surface.

8. The container as claimed in claim 7, wherein the flange is at least partly flexible.

9. The container as claimed in claim 7, wherein the container is formed of sheet steel.

* * * * *